United States Patent [19]

Clendening

[11] Patent Number: 4,665,389

[45] Date of Patent: May 12, 1987

[54] PERSONAL DISTRESS SIGNALLING DEVICE

[76] Inventor: Susan Clendening, 907 La Baie, Rigaud, Quebec, Canada

[21] Appl. No.: 828,754

[22] Filed: Feb. 10, 1986

[30] Foreign Application Priority Data

Sep. 12, 1985 [CA] Canada ..... 490624

[51] Int. Cl.[4] ..... G08B 13/02

[52] U.S. Cl. ..... 340/574; 340/693

[58] Field of Search ..... 340/574, 573, 693, 571, 340/568

[56] References Cited

U.S. PATENT DOCUMENTS

| | | | |
|---|---|---|---|
| 2,135,476 | 11/1938 | Rugh | 340/574 |
| 4,136,338 | 1/1979 | Antenore | 340/568 |
| 4,284,982 | 8/1981 | Downey | 340/546 |
| 4,392,126 | 7/1983 | Loyola | 340/573 |
| 4,404,549 | 9/1983 | Berg | 340/574 |
| 4,593,273 | 6/1986 | Narcisse | 340/539 |

FOREIGN PATENT DOCUMENTS

| | | |
|---|---|---|
| 327555 | 3/1932 | Canada . |
| 671273 | 10/1963 | Canada . |
| 743798 | 10/1966 | Canada . |
| 1101959 | 5/1981 | Canada . |
| 1130884 | 8/1982 | Canada . |

*Primary Examiner*—Glen R. Swann, III

*Attorney, Agent, or Firm*—Salter & Michaelson

[57] ABSTRACT

A distress signalling device comprises a casing having a compartment therein, a belt adapted to be wrapped about a body part of a person, a mechanism for detachably securing the belt to the casing in such a manner that the belt cannot be removed from the person until it is detached from the casing by an authorized person, an electrical circuit disposed in the compartment, the circuit including an alarm, a mechanism for activating the circuit, and a source of electrical power serially connected to one another, the circuit being arranged so that the alarm cannot be de-activated until the belt is detached from the casing.

14 Claims, 4 Drawing Figures

PERSONAL DISTRESS SIGNALLING DEVICE

BACKGROUND OF THE INVENTION

This invention relates to a personal distress alarm signalling device and, particularly, to a signalling device which is arranged to be secured to the body of a child for use by the child who is lost or in danger.

The present invention is particularly concerned with the safety of children and specifically with the safety of children who become separated from their parents or guardians while in a shopping center, attending a fair or the like, while camping or hiking, and while walking to and from school. In some of these instances, it is very difficult to find a lost child before it encounters a dangerous situation. The present invention is also concerned about the sharp increase in child abductions in recent years. In many of these situations, the danger may be eliminated if the lost child was capable of emitting a cry of sufficient magnitude for an extended period of time, which the natural voice cannot do. In the case of abductions, a child may actually be prevented from doing this.

SUMMARY OF THE INVENTION

The primary object of the invention is to provide an alarm device which is capable of issuing an alarm signal for an extended period of time and which can be attached to a child in such a manner that it can be removed only by an authorized person, such as a parent or guardian, and which, when activated, can be de-activated only by an authorized person.

In general, the present invention provides a distress signalling device, comprising a casing, belt means adapted to be wrapped about a body part of a person, lock means for detachably securing a portion of the belt means in the casing in such a manner that the belt means cannot be removed from the person until the lock means has been unlocked, and electrical circuit means disposed in the casing. The circuit means includes alarm means, means for activating the circuit means, and a source of electrical power serially connected to one another and is arranged so that, once the circuit means has been activated and the alarm means energized, the alarm means cannot be de-energized until the belt means is detached from the casing.

BRIEF DESCRIPTION OF THE DRAWINGS

These and other features of the invention will become more apparent from the following description in which reference is made to the appended drawings in which.

DETAILED DESCRIPTION OF A PREFERRED EMBODIMENT

Figure 1:
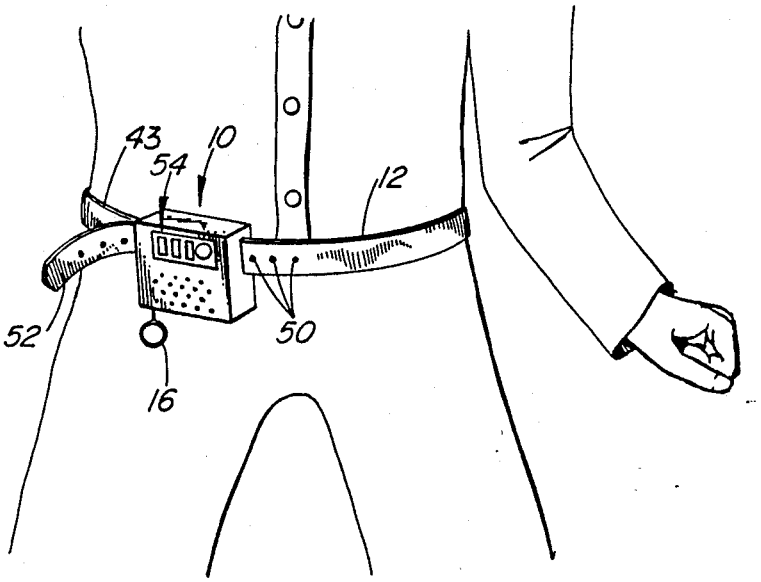
FIG. 1 is a view of the mid-portion of a child wearing the distress signalling device of the present invention.
Figure 2:
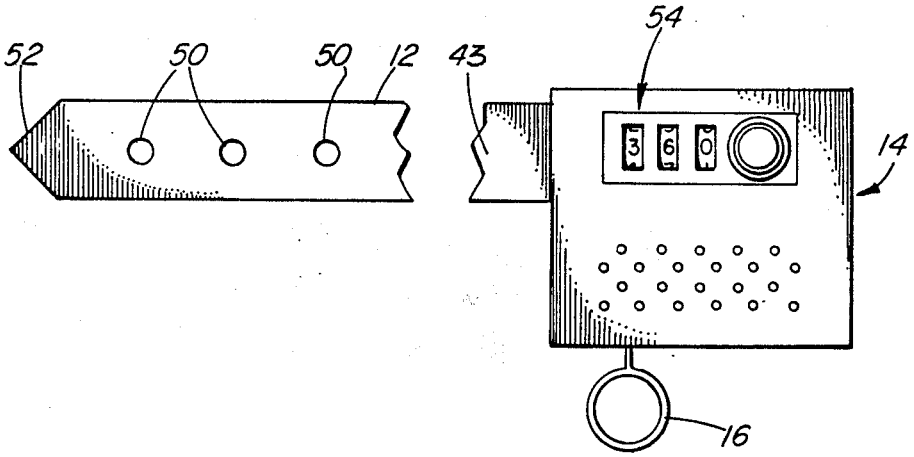
FIG. 2 is an elevational view of the distress signalling device of the present invention.

With reference to FIGS. 1 and 2, the distress signalling device of the present invention, generally designated by reference numeral 10, comprises a belt 12 adapted to be selectively and adjustably, detachably secured about the waist of a person by means of a buckle arrangement generally designated by numeral 14. The belt and buckle are integral, the buckle being formed at one end of the belt, and formed of reinforced, plastic material. As explained more fully later, the buckle is provided with a security or lock means for locking the free end of the belt within the buckle so that the belt can be removed from the wearer only by opening the lock. A pull string 16 depends from the buckle and, when pulled by the wearer when lost or in danger, activates an alarm means disposed in a compartment or chamber within the buckle. The device is arranged so that the alarm cannot be de-activated until the lock has been opened by an authorized person and the belt has been removed from the buckle.

Figure 3:
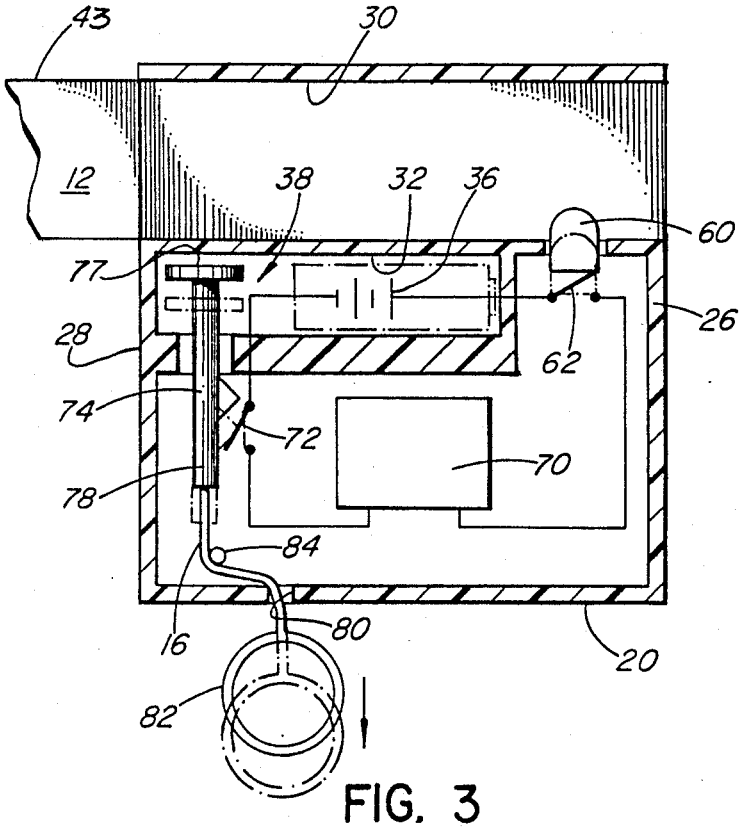
FIG. 3 is a diagrammatic, longitudinal cross-sectional view of a signalling device constructed in accordance with the present invention.
Figure 4:
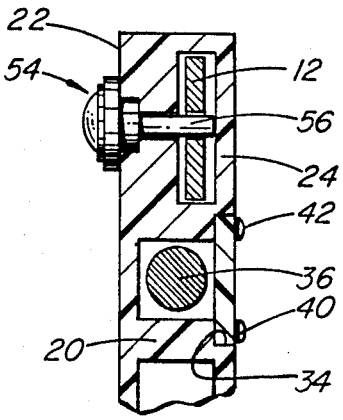
FIG. 4 is a diagrammatic, partially broken, cross-sectional view of the distress signalling device of the present invention illustrating a security or lock means.

With particular reference to FIGS. 2, 3 and 4, the buckle comprises a casing 20 having a front side 22, a back side 24 and opposed ends 26 and 28. A passageway 30, of generally rectangular cross-section, extends through the casing from end 26 to the end 28 and is adapted to longitudinally receive therethrough the free end of belt 12 in a snug fit relationship. A first compartment 32 in the casing is provided with an access opening 34 in the back side 24 for receiving a battery 36 providing electrical energy for circuit means described below. As explained later, reset means 38 for resetting the device is disposed in compartment 32. A cover or lid 40 is provided for closing access opening 34 and is secured to the casing by suitable lock means 42 for preventing unauthorized access to the compartment. Lock means 42 may be in the form of screws, a key operated lock, a combination lock or the like.

Proximal end 43 of belt 12 is integral with the casing with the longitudinal axis of the belt extending substantially parallel to the axis of the passageway. The device is worn such that front side 22 of the casing is remote from the wearer. In this manner, the lid 20 is disposed against the wearer and this makes it more difficult for an unauthorized person to attain access to compartment 32 for the purpose of de-activating the alarm means.

Means is provided for securing the belt to the casing. This includes a plurality of longitudinally spaced apertures or holes 50 formed along the longitudinal axis of the free or distal end of the belt and lock means 54 secured to the front wall of casing 14. Lock means 54 includes a locking pin 56 which is movable transversely across passageway 30 between an extended, locking position and a retracted, unlocking position and is sized to be received in one of the aforementioned apertures in the belt. Spring means (not shown) within the lock casing resiliently urges the pin to the pin retracted position. A latch (not shown), within the lock casing, engages the locking pin in the extended position thereof and, once the lock has been set, prevents the locking pin from returning to is retracted, unlocking position until the lock has been opened. The invention contemplates any suitable form of lock such as the combination lock shown in the drawings, a key operated lock, a dial lock or the like. The specific construction of the lock does not in itself constitute part of the present invention and, accordingly, the lock has not been described.

A switch actuator 60, associated with a switch 62, is mounted in the passageway 30 for engagement with belt 12 when the belt is inserted into the passageway. The actuator is movable between a switch opening position, shown in solid lines in FIG. 3, whereat the actuator extends into the passageway and a switch closing position, shown in dotted lines, whereat the actuator is substantially removed from the passageway as a result of engagement with the belt. Spring means (not shown) urges the actuator to its switch opening position.

Electrical circuit means is disposed in the casing and includes, in electrically serially connected relation, audible alarm means or screecher 70, first switch 62, a second switch 72, for opening and closing the circuit, and battery 36. An operating member 74, movable between the solid and dotted lines shown in FIG. 3, is provided for opening and closing switch 72. One end 76 of the operating member extends into the compartment 32 constitutes aforementioned reset means 38 and is provided with a tab 77 manipulated from within the compartment to move switch 72 from its closed position to its opened position. The other end 78 of the operating member is attached to pull cord 16, made of nylon (trade mark) or the like, which extends to the exterior of the casing via an aperture 80. A ring 82 is secured to the end of the cord to facilitate manipulation thereof. The pull cord is trained about a pin 84 in the casing in such a manner that switch 72 cannot be opened, once it has been closed, by feeding the pull cord back into the casing.

In use, the belt is placed about the waist of a person and the free end is inserted into passageway 30. As the belt passes through the passageway actuator 60 is depressed and switch 62 is thereby closed. Once the belt has been suitably adjusted, locking pin 56 is extended into the appropriate one of the apertures in the belt and lock 54 is set. When this has been achieved, the belt cannot be removed from the wearer until the lock has been opened by an authorized person. Thus, if thereafter the pull string is tensioned sufficiently to close switch 72, the alarm will be activated and will remain activated until lock 54 is opened and the belt is removed from the passageway. This would allow actuating member 60 to return to its extended position and switch 62 to open. Operating member 74 is reset by opening the rear compartment lid and lifting tab 77.

The battery capacity and the screecher are selected to provide a loud sound for an extended period of time. Since the belt cannot be removed and the alarm cannot be de-activated, except by an authorized person, there will be sufficient time in many instances of lost children to locate the child within the useful life of the battery. In the case of an attempted abduction, the abductor would quickly abandon the attempt since he would be unable to remove the belt or de-activate the alarm.

It will be understood that various alterations and modifications may be made to the above described device without departing from the spirit of the invention. For example, the alarm means may comprise an r.f. transmitter or like device which would emit an inaudible signal to a receiver at a remote location. Alternatively, the alarm means may be a combination of an audible alarm and transmitter of the type just referenced. In such an arrangement, the electrical circuit could be arranged to activate the transmitter on an intermittent basis once battery power has been reduced to a predetermined level. It will be understood further that the invention is not limited to the particular switches, actuators and locks described and shown, but rather that other equivalent devices may be employed. Still further, it is to be understood that the signalling device may be adapted to be secured to other parts of the body of the wearer, such as the arm or leg, without departing from the scope of the invention.

What is claimed is:

1. A distress signalling device, comprising:

a casing;

belt means adapted to be wrapped about a body part of a person;

lock means for detachably securing a portion of said belt means in said casing in such a manner that said belt means cannot be removed from said person until said lock means has been unlocked; and electrical circuit means disposed in said casing, said circuit means including alarm means, means for activating said circuit means, and a source of electrical power serially connected to one another, said circuit means being arranged so that, once said circuit means has been activated and said alarm means has been energized, said alarm means cannot be de-energized until said belt means is detached from said casing.

2. A distress signalling device as defined in claim 1, said activating means including in combination:

first switch means for opening and closing said circuit means, said first switch means being responsive to the presence of said belt in said casing to close a first portion of said circuit means; and second switch means for opening and closing said circuit means, said second switch means being serially connected with first switch means, disposed in said casing and having an actuating member extending outwardly of said casing, said actuating member being movable between a first position for closing said second switch means and a second position for opening said second switch means, said actuating member being movable from said first position to said second position only by manual manipulation thereof from the interior of said compartment.

3. A distress signalling device as defined in claim 1, said casing having a compartment therein for housing at least said source of electrical power, a cover for opening and closing said compartment, and second lock means adapted to lock said cover in a closed position and permit selective access to said compartment only by an authorized person.

4. A distress signalling device as defined in claim 3, said second lock means being at least one screw for securing said cover to said casing.

5. A distress signalling device as defined in claim 3, said lock means being a key operated lock.

6. A distress signalling device as defined in claim 3, said lock means being a combination lock.

7. A distress signalling device as defined in claim 3, said activating means being a switch means disposed in said compartment and having an actuating member extending outwardly of said housing and being movable between a first position for closing said switch means and a second position for opening said switch means, said actuating member being movable from said first position to said second position only by manual manipulation thereof from the interior of said compartment.

8. A distress signalling device as defined in claim 7, said actuating member including a flexible cord extending to the exterior of said casing for moving said actuating member from said second to said first position.

9. A distress signalling device as defined in claim 1, said casing including a passage extending therethrough adapted to longitudinally receive said belt means in a snug fit relationship.

10. A distress signalling device as defined in claim 9, said lock means being secured to said casing and having a locking pin movable between an extended position whereat said locking pin extends across said passage and a retracted position whereat said locking pin is removed from said passage, said locking pin being adapted to be received in an aperture in said belt means when said belt means is positioned in said passage and said aperture is aligned with said locking pin.

11. A distress signalling device as defined in claim 10, said electrical circuit means further including first switch means for opening and closing said circuit means, said first switch means being responsive to the presence of said belt in said passage by closing said circuit means and rendering said circuit operative.

12. A distress signalling device, comprising:

belt means adapted to be wrapped about the waist of a person and having a plurality of longitudinally spaced apertures adjacent at least one end thereof;

a casing having a front side, a back side and opposed ends, a passageway extending through said casing from one of said opposed ends to the other of said opposed ends and adapted to longitudinally receive said belt means therethrough in a snug fit relationship, a compartment in said casing, a cover in said back side of said casing for opening and closing said compartment and lock means for locking said cover in a closed position for preventing unauthorized access to said compartment, the end of said belt means remote from said one end being substantially permanently secured to said casing with the longitudinal axis of said belt means extending substantially parallel to the axis of said passageway, said device being arranged to be worn with said front side being remote from the wearer;

lock means for securing said belt means to said casing including a locking pin movable between an extended position whereat said locking pin extends across said passageway and a retracted position whereat said locking pin is removed from said passage, said locking pin being adapted, in said extended position thereof, to be received in one of said apertures in said belt means when said belt means is positioned in said passageway and said aperture is aligned with said locking pin;

electrical circuit means disposed in said compartment, said circuit means including, in electrically serially connected relation, first switch means for opening and closing said circuit means, said first switch means being responsive to the presence of said belt in said passage by closing said circuit means and rendering said circuit operative, audible alarm means, manually operable second switch means for opening and closing a second part of said circuit means, a source of electrical power;

said second switch means having an operating member movable between a first position whereat said second switch means is closed and a second position whereat said second switch means is open, a pull cord secured to said operating member and extending to the exterior of said casing, said pull cord being operative to move said operating member from said second position to said first position and being inoperative to move said operating member from said first position to said second position, said second switch means being arranged so that said operating member can be moved from said first position to said second position only by manual manipulation thereof after opening said cover.

13. A distress signalling device as defined in claim 2, said alarm means including an audible alarm.

14. A distress signalling device as defined in claim 2, said alarm means including a transmitter.

* * * * *